US006663324B2

(12) United States Patent
Nordloh

(10) Patent No.: US 6,663,324 B2
(45) Date of Patent: Dec. 16, 2003

(54) EROSION BLANKET INSTALLATION DEVICE

(76) Inventor: Thomas H. Nordloh, 4111 Taft Rd., Kenosha, WI (US) 53142

( * ) Notice: Subject to any disclaimer, the term of this patent is extended or adjusted under 35 U.S.C. 154(b) by 0 days.

(21) Appl. No.: 10/125,164

(22) Filed: Apr. 18, 2002

(65) Prior Publication Data

US 2003/0198522 A1 Oct. 23, 2003

(51) Int. Cl.[7] ..... E02D 17/20

(52) U.S. Cl. ..... 405/302.6; 405/302.7; 405/15; 405/16

(58) Field of Search ..... 405/15, 16, 17, 405/19, 129.75, 129.9, 302.6, 302.7, 302.4

(56) References Cited

U.S. PATENT DOCUMENTS 4,175,496 A * 11/1979 Rehbein ..... 111/200
4,666,337 A * 5/1987 Pinto ..... 405/176
4,878,542 A 11/1989 Brouwer et al.
5,039,250 A * 8/1991 Janz ..... 405/302.6
5,525,012 A * 6/1996 Casimaty et al. ..... 405/302.7
5,526,759 A * 6/1996 Cox ..... 405/176
5,536,116 A * 7/1996 Lammers et al. ..... 405/129.9
5,620,281 A * 4/1997 Lammers et al. ..... 405/129.9
5,697,452 A 12/1997 Link
6,131,668 A 10/2000 Houska
6,158,923 A * 12/2000 Wheeler et al. ..... 405/116
6,171,022 B1 * 1/2001 Decker ..... 405/16
6,264,400 B1 * 7/2001 Gent ..... 405/129.75
6,267,535 B1 * 7/2001 Brauer et al. ..... 405/129.9
6,398,459 B1 * 6/2002 Vreeland ..... 405/302.6
2003/0072622 A1 4/2003 McPhillips

* cited by examiner

*Primary Examiner*—Heather Shackelford
*Assistant Examiner*—Frederick L. Lagman
(74) *Attorney, Agent, or Firm*—Jansson, Shupe & Munger, Ltd.

(57) ABSTRACT

An improved device and method for mechanically installing erosion blankets on a ground surface. The device holds a roll of an erosion blanket and provides that the blanket unwind when the device is propelled forward. Upon unwinding, the device positions the blanket on the ground and pins the blanket in position using staples, stakes or the like. Preferred embodiments of the device provide for furrowing of the ground before installation of the blanket.

44 Claims, 4 Drawing Sheets

EROSION BLANKET INSTALLATION DEVICE

FIELD OF THE INVENTION

This invention is related generally to prevention of erosion and promotion of seed germination in soil, and more particularly, to installation of erosion blankets to prevent erosion and promote seed germination.

BACKGROUND OF THE INVENTION

Erosion blankets are used throughout the world to stabilize soil before seed germinates and/or small plant plugs cover the ground. Erosion blankets are used for a variety of reasons, such as stabilizing large areas along highways, stabilizing areas around detention/retention ponds, establishing fine quality lawns for commercial and residential properties and restoring prairies. Erosion blankets are typically provided in rolls of 65 to 100 yard rolls, depending upon the type of blanket. The most widely used blankets are made of straw and wood fiber. Typically, erosion blankets of every type are installed by hand.

Erosion blankets are typically utilized to keep the soil and seed from eroding away during and after precipitation. In addition to preventing erosion, such blankets retain moisture in the soil under the blanket for a much longer period of time. The extended presence of moisture enables the seed to germinate much more quickly than without blanket cover.

In addition, erosion blankets retard weed growth when grass seed is planted in the late spring and early summer months. Due to the consistent shade that is provided by the erosion blanket the vast majority of noxious weed seed will not germinate.

In the landscaping industry, two alternative products are often used to encourage seed germination. These products are straw mulch and hydro mulch, both of which are typically mechanically blown or dropped onto the soil. However, bales of straw which are broken apart and spread on the soil as straw mulch can blow away which leads to mixed results. Hydro mulch, a paper component with seed and fertilizer mixed in slurry of water, helps the seed germinate but does not control erosion. Furthermore, hydro mulch is a poor medium to keep moisture in the soil during critical dry times of the growing season. While straw mulch and hydro mulch are less effective than erosion blankets, their use is popular due to their lower associated costs, especially the labor costs involved in installing the mulch on the soil.

Erosion blankets are typically installed after a site has been fine graded (soil prepared for seed) and seeded. The seed may be broadcast or installed using a mechanical seeder. For use with small plant plugs, the erosion blanket is installed and the plant plugs are manually planted into the blanket. In either use, after the erosion blanket has been laid on the ground, stakes must be manually driven through the blanket into the ground to keep the blanket in correct position. The stakes are typically six inches long and must be driven deep enough such that they are flush with the erosion blanket so that mowers do not strike them. The manual operations dealing with the installation of stakes significantly increase the cost of installing an erosion blanket and often lead landscapers to use the less labor-intensive products mentioned above for reasons involving both time and costs.

Therefore, there is a continuing significant need in the field of erosion prevention and seed germination promotion for improvements related to the installation of erosion blankets and for more efficient installation thereof. An improved device and method achieving these goals would lead to better erosion protection and, therefore, higher quality lawns and prairies, as well as cleaner lakes, creeks, streams, rivers and oceans.

OBJECTS OF THE INVENTION

It is an object of the invention to provide an improved device which efficiently installs erosion blankets.

Another object of the invention is to provide an erosion blanket installation device which is simple in structure and operation in order to facilitate effective installation.

Another object of the invention is to provide an erosion blanket installation device which mechanically drives stakes into the ground to hold the blanket in position.

Another object of the invention is to provide an erosion blanket installation device which mechanically drives staples into the ground to hold the blanket in position.

Another object of the invention is to provide an erosion blanket installation device which simultaneously unrolls and pins to the ground the erosion blanket.

Another object of the invention is to provide a method of mechanically installing an erosion blanket on the ground.

Still another object of the invention is to provide a method of installing an erosion blanket on the ground which minimizes the need for manual operations during installation.

Still another object of the invention is to provide an easy penetration point in the ground for the insertion of a stake which automatically pins an erosion blanket to the ground.

Yet another object of the invention is to provide a method of automatically pinning an erosion blanket to the ground during installation.

These and other objects of the invention will be apparent from the following descriptions and from the drawings.

SUMMARY OF THE INVENTION

This invention is an improved method and device for efficiently and effectively installing erosion blankets on ground surfaces. The invention represents a significant advance over the state of the art by providing a novel device, which allows for an automatic method of installation which is heretofore unknown in the art.

The erosion blanket installation device is able to install a 500 yard roll of a straw erosion blanket on the ground while securing the blanket in place until the turf or vegetation naturally stabilizes the ground soil via a staple or a pneumatically driven stake which enters a 5"–6" furrow.

The device for installing an erosion blanket, i.e., laying and securing the blanket along a pathway on the ground, is comprised of a vehicle frame, an axle arm connected with respect to the vehicle frame and engaging an axle around which the blanket roll is sleeved, at least one staple or stake gun connected with respect to the frame and at least one staple or stake cartridge connected with respect to the gun for supplying staples or stakes to pin the blanket to the ground.

The erosion blanket is rolled so that it may be sleeved around the blanket axle before use of the device. The blanket is positioned in the vehicle frame by sliding the roll around the blanket axle. As the device is propelled along the pathway the blanket is unwound from the roll and is placed on the ground. The device preferably includes a blanket guide roller for which directs the blanket to the ground upon unwinding. The gun pins the blanket in position by driving a staple or stake through it into the ground.

For use with a stake gun, rather than a staple gun, the device also preferably includes at least one furrow blade connected with respect to the frame. Preferably three furrow blades are supported by a furrow bar which is connected to a hydraulic cylinder which urges the blades into the ground. The blades furrow the ground during movement of the device and are urged to stay in position by their arcuate shape.

The preferable device includes at least one hitch connection point connected with respect to the frame. The hitch connection points are designed to connect to a hitch of a tractor or other vehicle which is able to tow the device. There are preferably three hitch connection points to provide sufficient connection to the towing vehicle.

The preferable device further includes an air compressor which is connected to each gun for forcing staples or stakes through the blanket into the ground. An air compressor is connected to each gun via a compressor hose and allows for pneumatic pinning of the blanket.

It is also preferred that the device include a retractable arm which is connected with respect to the frame. The retractable arm is movable between an open position which allows the roll to be loaded by sliding over the blanket axle and a closed position in which the retractable arm engages the free end of the blanket axle to hold the roll in place. A spring-loaded retractable-arm pin is connected with respect to the frame and pivotably supports the retractable arm with respect to the frame. A retractable-arm brace connects the retractable-arm pin to the frame. In use, the retractable arm is pivoted so that the erosion blanket may be positioned within the vehicle. After the blanket roll is in position within the device, the retractable arm is pivoted so that the second end of the blanket axle may engage the retractable arm to hold the roll in place.

In another preferred embodiment the device includes at least one compression wheel for pressing the blanket against the ground as the blanket unwinds. The compression wheel is supported by a compression-wheel frame. The compression-wheel frame preferably supports each gun and staple or stake cartridge as well.

The novel method of installing erosion blankets on ground surfaces comprises (a) propelling a blanket-laying device along a pathway, (b) rotating the roll of the erosion blanket supported in the device such that the blanket unwinds and is positioned on the surface along the pathway; and (c) in conjunction with the rotating step, mechanically pinning the blanket to the ground.

It is preferred that the rotating and pinning steps are performed simultaneously. The rotating and pinning steps are also preferably performed continuously until the roll expires. Furthermore, the rotating step is preferably performed in conjunction with, and as a result of, the propelling step. That is, the propelling of the device causes the roll to rotate and unwind. In the novel method, the blanket is preferably initially anchored to the ground surface by manually driving staples or stakes through the blanket into the yard. However, alternate embodiments of the invention allow for the blanket to be anchored to the ground without any manual manipulation.

The preferred method includes the step of pressing the blanket to the surface as it unwinds from the roll to allow for effective surface coverage. Such step is preferably performed by compression wheels, and more preferably by at least 3 axially-spaced compression wheels, e.g., one wheel pressing the left side of the blanket, one wheel pressing the middle of the blanket, and one wheel pressing the right side of the blanket.

The preferred method also includes the step of furrowing the surface before the pinning step. Such a step is preferably performed by at least 3 blades which are aligned with the means for mechanically pinning the blanket to the ground.

The device is preferably propelled along the pathway at at least about 3 miles per hour (mph). A tractor or similar vehicle can be connected to the device via a hitch in order to tow the device at the proper velocity. It is preferred that the erosion blanket is installed on the surface at a rate of at least about 400 yards every 3 minutes, or 400 feet/minute. Even more preferably, the erosion blanket is installed on the surface at a rate of at least about 500 yards every 3 minutes, or 500 feet/minute.

The pinning step is preferably performed using staples or stakes. Such staples or stakes are preferably biodegradable. The staples or stakes are preferably forced through the blanket into the ground by an air compressor included in the vehicle. As discussed above, the air compressor is connected to a gun which fires the staples or stakes into the ground. The gun is connected to a staple or stake cartridge which supplies the staples or stakes.

It is preferable that the number of staples or stakes held by the device be proportional to the length of the roll. Upon expiration of the roll positioned in the device, the preferred method includes the steps of loading staples or stakes and another roll of the blanket with respect to the device; propelling the device along a pathway; rotating the roll such that the blanket unwinds and is positioned on the surface along the pathway; and in conjunction with the rotating step, mechanically pinning the blanket to the ground.

The step of loading staples or stakes and another roll is preferably accomplished in less than about 15 minutes. The preferred method uses blanket rolls which are 500 yards long and at least 15,000 yards of blanket are installed in 8 hours.

An alternate method of installing an erosion blanket along a pathway on a ground surface comprises providing a roll of an erosion blanket; supporting the roll in a device; propelling the device in a direction along a pathway; and unwinding the roll so that the blanket covers the pathway, the device automatically pinning the blanket to the ground surface as it unrolls.

The preferred alternate method further comprises the step of pressing the blanket to the surface as it unwinds to allow for effective surface coverage. Such a step is preferably performed by compression wheels, and more preferably by at least 3 axially-spaced compression wheels.

The preferred alternate embodiment also comprises the step of furrowing the surface simultaneous with the propelling step. The furrowing step is preferably performed by at least 3 blades The pinning step is preferably performed using staples or stakes. The staples and stakes are preferably biodegradable and are forced through the blanket into the ground by an air compressor included in, or connected to, the device.

In the preferred alternate method, the erosion blanket is installed on the surface at a rate of at least about 400 feet/minute. More preferably, the erosion blanket is installed on the surface at a rate of about 500 feet/minute.

DETAILED DESCRIPTION OF PREFERRED EMBODIMENTS

Figure 1:
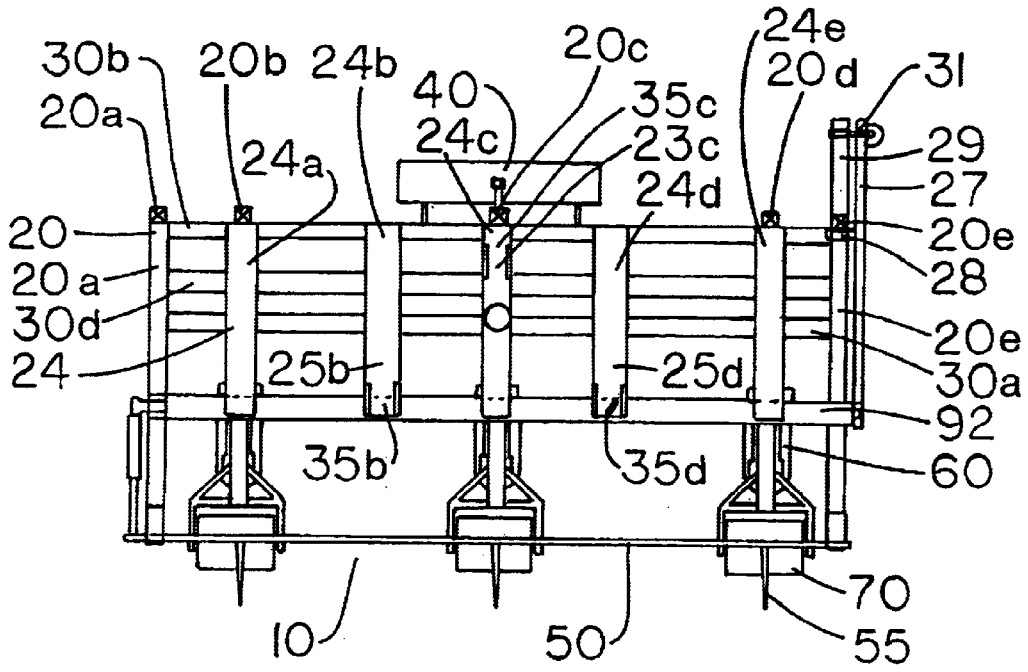
FIG. 1 is a front view of the erosion-blanket-laying device in accordance with the invention.
Figure 3:
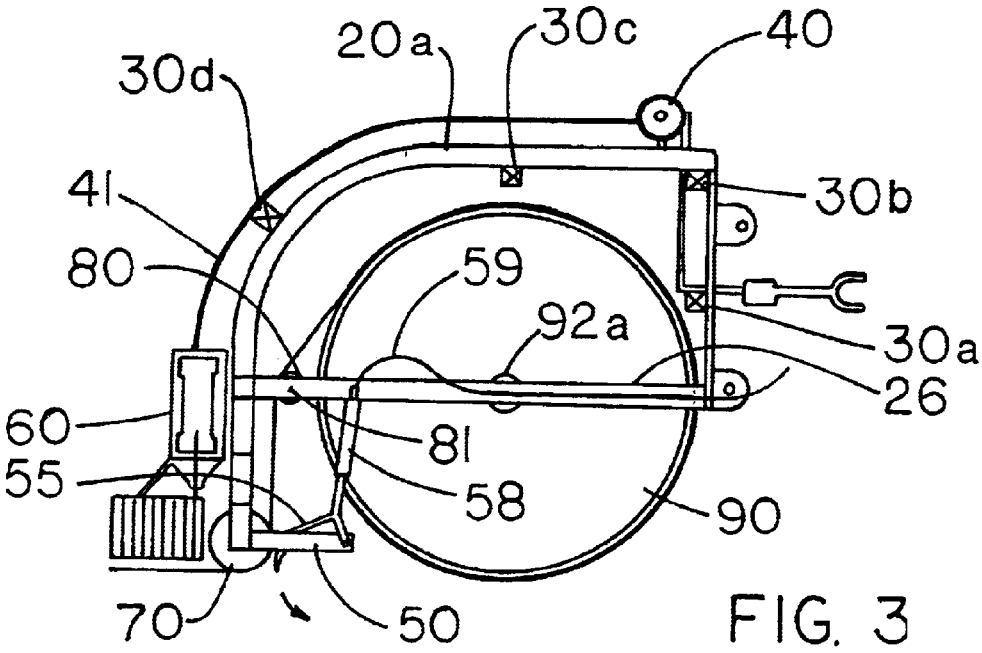
FIG. 3 is a view from the right side of the erosion-blanket-laying device in accordance with the invention.
Figure 4:
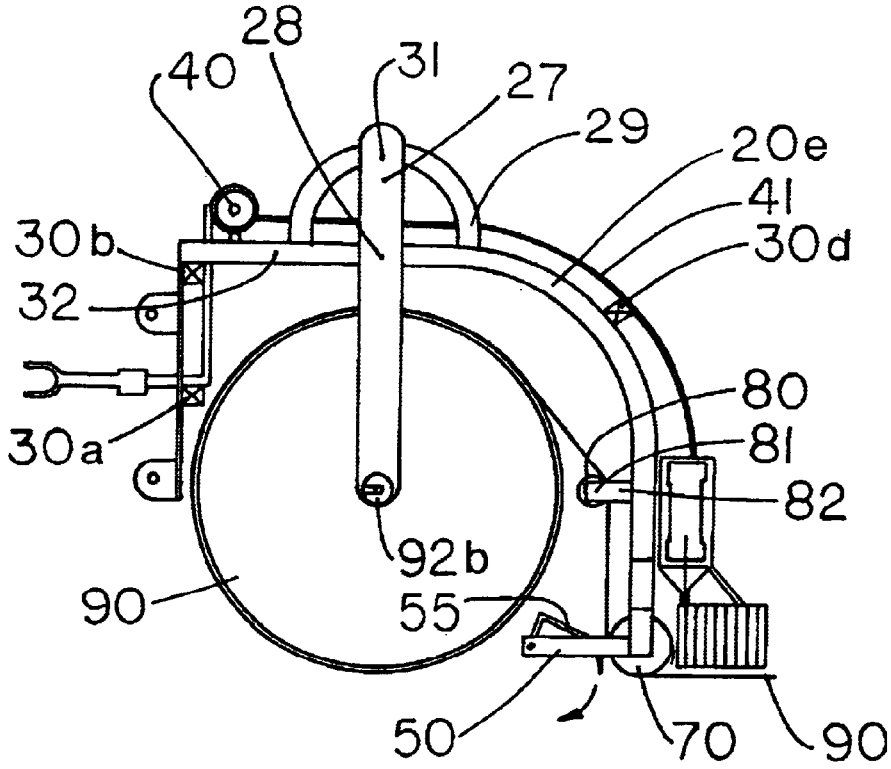
FIG. 4 is a view from the left side of the erosion-blanket-laying device in accordance with the invention.

FIG. 1 is a front view of the erosion-blanket-laying device 10 in accordance with the invention. Device 10 includes a frame 20 which comprises five frame supports (two external frame supports 20*a*, 20*e* and three internal frame supports 20*b*, 20*c*, 20*d*) which, as seen in FIGS. 3 and 4, extend horizontally from the front before arcing downwardly toward the rear of device 10. Frame supports 20*a*, 20*b*, 20*c*, 20*d*, 20*e* are connected by front frame crossbars 30*a*, 30*b* and rear crossbars 30*c*, 30*d*. Each frame support and crossbar is preferably 2" by 2" steel framing (hollow square framing with a thickness of ¼"). Alternatively, each frame support and crossbar is 90-degree angle bar. Preferably, the frame supports and crossbars are 1018 Cold Roll steel.

Connected to front frame crossbars 30*a*, 30*b* is a vertical stabilizer frame 24 comprising five vertical stabilizer bars 24*a*, 24*b*, 24*c*, 24*d*, 24*e*. Vertical stabilizer bars 24 are preferably flat pieces which are 4" wide, ½" thick and 1'11" to 2' long. Lower end 25*b* of vertical stabilizer bar 24*b* is connected to hitch-connection point 35*b*. Upper portion 23*c* of vertical stabilizer bar 24*c* is connected to hitch-connection point 35*c*. Lower end 25*d* of vertical stabilizer bar 24*d* is connected to hitch-connection point 35*d*. The three hitch connection points 35 provide for connection of device 10 to a tractor or other towing vehicle. Such a vehicle preferably has a category 2, three-point hitch and at least a 100 hp engine. All connections between frame supports 20, cross bars 30 and hitch-connection points 35 are weldings.

As seen in FIG. 3, fixed axle arm 26 is welded to a rear portion of external frame support 20*a* and extends forward. Axle arm is preferably 2" by 2" steel framing. Axle arm 26 includes a connection point for erosion blanket axle 92. Preferably, blanket axle 92 is welded to axle arm 26 at distal end 92*a* of blanket axle. Erosion blanket 90 (shown in FIGS. 3 and 4) is wound into a roll so it can be slipped onto blanket axle 92 when being positioned in device 10. Blanket axle 92 is preferably made of lightweight polished steel with ⅜" thick wall. Blanket axle preferably has a diameter of 3½" and a length of about 6'7". Blanket axle 92 must have sufficient strength to hold a 500 yard blanket roll which has an approximate mass of 150 lbs.

As seen in FIG. 4, retractable arm 27 is connected to external frame support 20*e* through retractable arm pivot 28 so that retractable arm 27 may swing about pivot 28. Retractable arm 27 is preferably constructed from flat bar steel. The lower end of retractable arm 27 has an opening provide for connection to the proximal end 92*b* of blanket axle 92. Pressure clips (not shown) are provided at the opening to hold the connection to blanket axle 92 in place. Such pressure clips can be opened manually in order to disconnect blanket axle 92 from retractable arm 27.

Retractable-arm brace 29 is connected to frame support 20*e*. Provided on retractable-arm brace 29 is a connection point for spring-loaded retractable-arm lock 31. Retractable-arm lock 31 is preferably a spring-loaded pin which passes through retractable arm 27 and retractable-arm brace 29 to prevent retractable arm 27 from pivoting about retractable-arm pivot 28. In order to load a roll of erosion blanket 90, retractable-arm lock 31 is removed from retractable arm 27 and retractable arm 27 is pivoted about retractable-arm pivot 28 so that the lower end of retractable arm 27 is moved toward frame support 20*e*. Retractable arm 27 may be suspended in the blanket loading position by connection to pin hole 32. Erosion blanket 90 is positioned within the opening created by slipping blanket 90 over blanket axle 92 after retractable arm is pivoted out of the way. Then retractable arm 27 is pivoted back to its original locked position and proximal end 92*b* of blanket axle 92 is connected to the lower end of retractable arm 27. Retractable-arm lock 31 is reconnected to retractable arm 27 and retractable-arm brace 29 to lock blanket 90 in position.

Figure 6:
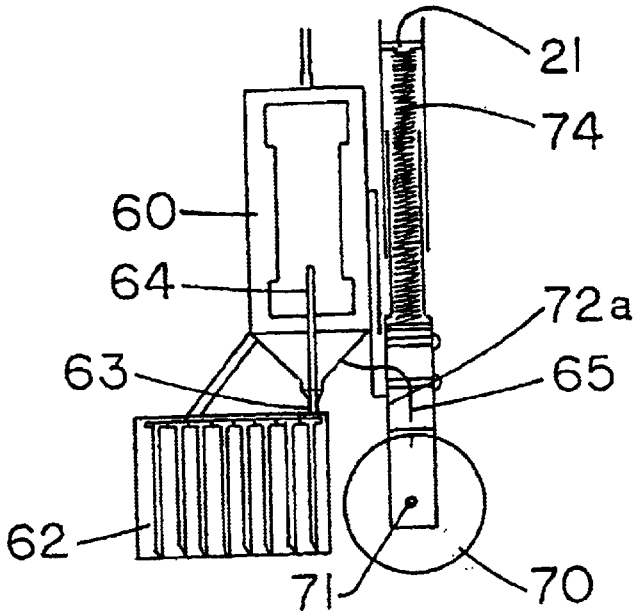
FIG. 6 is a detailed view of the compression wheel, gun and cartridge in accordance with the invention.

Compression wheels 70 are connected with respect to the lower end of interior frame supports 20*b*, 20*c*, 20*d*. Such connection is preferably through a spring-mounted piston-like arrangement (shown in FIG. 6) for reasons discussed below. Compression wheels 70 are preferably composite cement rollers epoxied with a textured rubber coating and have lengths of 9" and diameters of 6". The composite cement is preferably formed from poured concrete and fiberglass fibers which add strength and durability. The rubber surface is preferably ½" thick. Wheels 70 preferably weigh about 18.5 lbs each. Compression wheels 70 rotate about compression-wheel axles 71 which pass through forked wheel brackets 72. Compression-wheel axles are preferably of the ball bearing type.

Figure 7:
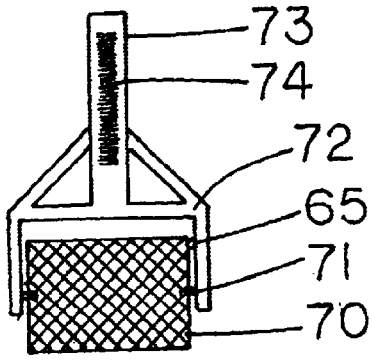
FIG. 7 is a detailed view of the compression wheel in accordance with the invention.
Figure 8:
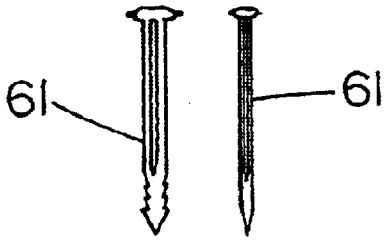
FIG. 8 is a detailed view of typical stakes for use with the erosion-blanket-laying device in accordance with the invention.

As shown in FIG. 7, wheel brackets 72 upwardly terminate in hollow bracket shafts 73 which house springs 74 with lengths of 12" and diameters of ¾". Bracket shafts 73 are preferably 1⅜" by 1⅜" and are received within the interior frame supports 20*b*, 20*c*, 20*d*. Springs 74 extend out of bracket shafts 73 and engage spring stops 21 which are positioned within interior frame supports 20*b*, 20*c*, 20*d*. Thus compression wheels 70 are urged downward from frame supports 20*b*, 20*c*, 20*d*. This configuration allows wheels 70 to support the weight of the device (approximately 1200 lbs.) while absorbing the vibrations encountered when the device is propelled along a pathway on the ground.

Mounted to the rear side 72*a* of each wheel bracket 72 is a gun 60. The mounting arrangement is preferably designed to allow for gun 60 to be easily removed from and reattached to wheel brackets 72. Preferably, each gun 60 is connected to each wheel bracket 72 with self-locking nuts. Each gun 60 has an outer hard metal casing with an airtight finish to prevent dust and water from entering the internal motor.

Figure 5:
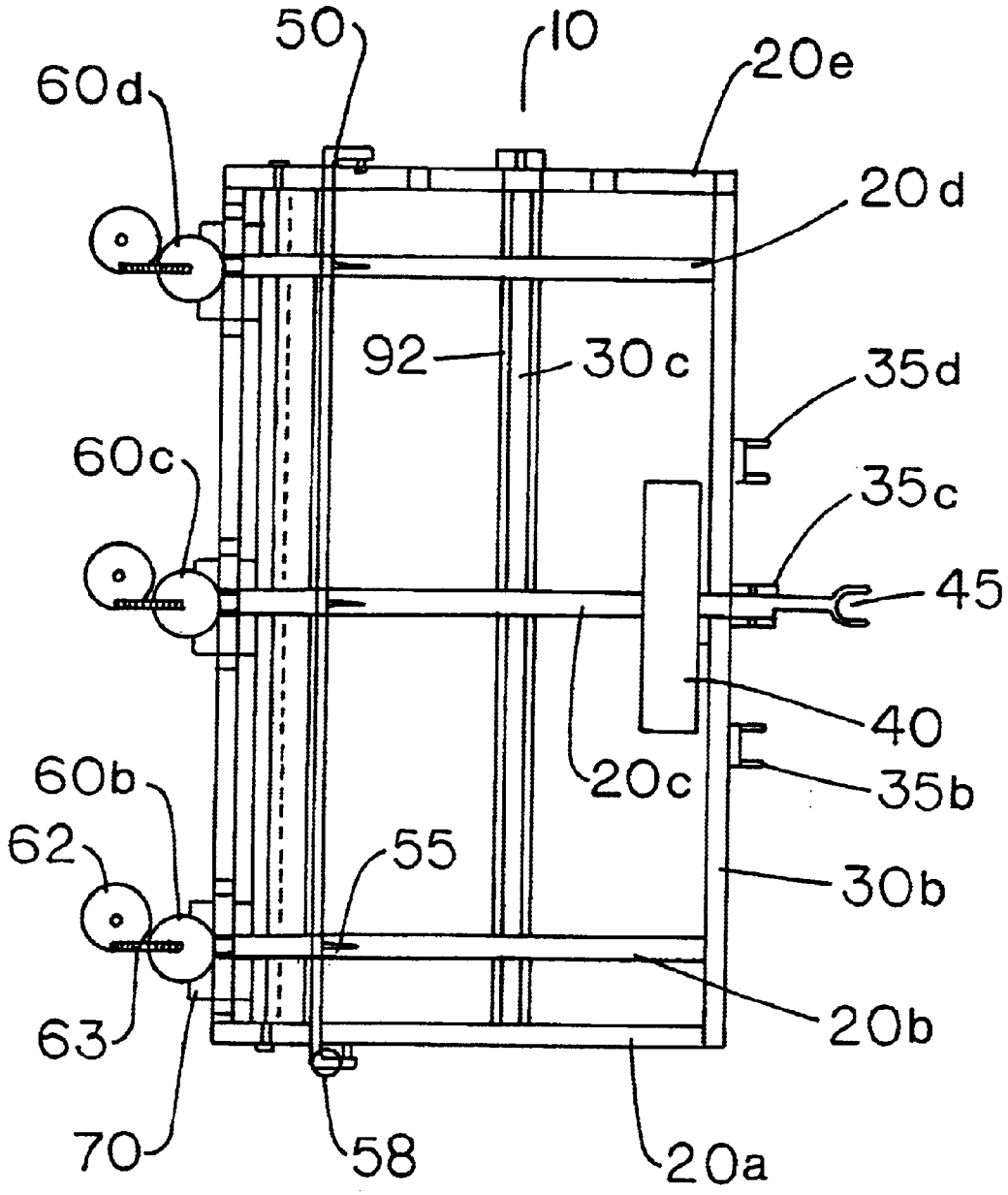
FIG. 5 is a overhead plan view of the erosion-blanket-laying device in accordance with the invention.

Each gun 60 is powered by air compressor 40 which is secured to the top of center frame support 20*c* (as seen in FIG. 5). Air compressor 40 is preferably comprised of a 2½ gallon steel tank with various air valves. The tank is pressurized by a compressor motor which is powered by a power take-off 45 from the tractor or other towing vehicle. Device 10 preferably includes a female power take-off fitting for connection to a male power take-off at the rear of the towing vehicle. Air-compressor hoses 41 extend from air compressor 40 and lead to guns 60. Air compressor 40 has a preferred operating pressure of between about 75 and 115 psi. Such pressure is sufficient to force staples or stakes 61 through blanket 90 and into the ground.

Before use, the air compressor is turned on and each pneumatic gun 60 is calibrated for a predetermined tractor speed and the number of staples or stakes to be installed per yard.

Cartridge 62 is connected to gun 60 to provide staples or stakes 61 for pinning blanket 90 to the ground. For use with stakes, each cartridge 62 holds approximately 170 stakes. By firing a stake every 3 feet, 170 stakes are used for 510 feet of erosion blanket. Therefore, three cartridges 62 are loaded into each gun 60 to provide enough stakes for a 500 yard roll of erosion blanket. Stakes 60 are preferably biodegradable and breakdown in the environment after about 6 months. Each stake 60 is preferably 6 inches long.

Guide chamber 63 (best shown in FIG. 5) allows stakes 61 to be forwarded to gun 60 and set into position for "hammer," one at a time, from the roll of stakes in cylindrical cartridge 62. Hammer mechanism 64 shoots stakes 61 into the ground one at a time when triggered by trigger wire 65.

Trigger wire 65 extends from hammer mechanism 64 to a position 2.87" from each wheel axle 71. Trigger wire 65 monitors each wheel 70 and triggers each hammer mechanism 64 every two revolutions of each wheel 70 (approximately every 3' the device travels). The middle trigger wire (connected to middle gun 60*c*) is preferably offset from the outer trigger wires (connected to outer guns 60*b*, 60*d*) by 1½ so that staples or stakes 60 are fired into blanket 90 in a pattern which more strongly secures blanket 90 to the ground.

Blanket guide roller 80 (FIGS. 3 and 4) is connected with respect to axle arm 26 and exterior frame support 20*e*. Guide roller 80 rotates about roller axle 81 which connects to roller bracket 82 and axle arm 26 through greased ball bearing fittings. Guide roller 80 preferably is lightweight steel with a ⅜" thick steel wall cylinder with a ¼" thick textured rubber surface covering. Roller axle 81 is preferably a 1" ball bearing axle. Roller bracket 82 is connected to exterior frame support 20*e*. When blanket 90 unwinds, it is directed between guide roller 80 and frame supports 20*b*, 20*c*, 20*d*. Blanket 90 is then directed downward to compression wheels 70 where blanket 90 is positioned on the ground surface.

Figure 2:
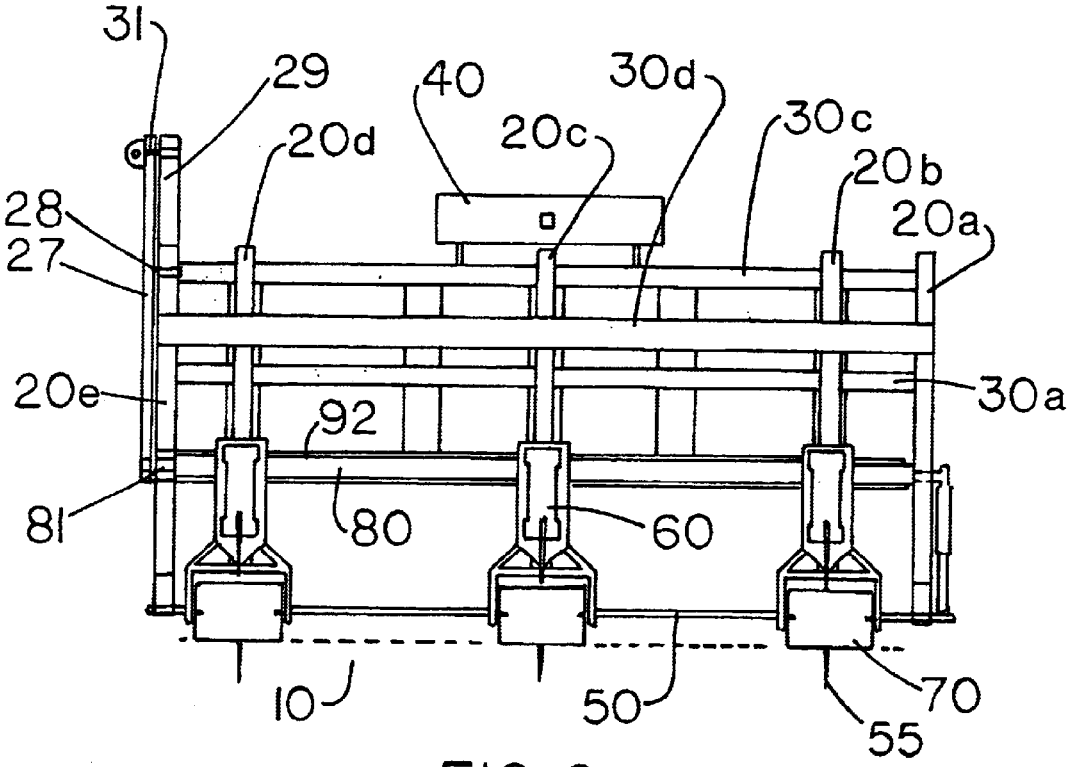
FIG. 2 is a rear view of the erosion-blanket-laying device in accordance with the invention.

Furrow bar 50 is pivotally mounted with respect to exterior frame supports 20*a*, 20*e* (shown in FIGS. 3 and 4) and supports three furrow blades 55. (shown in FIGS. 1 and 2). Each furrow blade 55 is aligned with a compression wheel 70 and gun 60. Each furrow blade 55 is preferably formed from A-36 Steel or a chromium based hardened steel. The blades 55 must be durable and replaceable in case of breakage. Each blade 55 is preferably 9" long and curved forward so that it digs into the ground during the forward motion of device 10.

Furrow bar 50 is preferably primarily 1" by 1" steel with ends which are ¾" diameter cylindrical steel to allow for pivoting with respect to device 10. Furrow bar 50 is pivotally attached to exterior frame supports 20*a*, 20*e* (shown in FIG. 5). Furrow bar 50 is not attached to wheel bracket 72. A 1" by 1" by 4" piece of steel is welded at the end of furrow bar 50 to attach to a commercially available hydraulic cylinder 58 with a steel eye bracket. The upper end of hydraulic cylinder 58 is connected to axle arm 26 with another steel eye bracket. Hydraulic hose 59 extends from the upper end of cylinder 58 and leads to a hitch connection point. A hydraulic control lever is positioned near the driver's seat in the tractor (not shown) so that the driver may activate the cylinder to raise or lower furrow bar 50 and, thus, furrow blades 55.

The total weight of the preferred device (including a 500 yard blanket roll) is approximately 1250 lbs. The total weight of the alternative device which uses 90 degree angle steel is approximately 975 lbs.

In order to begin use of the erosion blanket installation device, an erosion blanket roll must first be loaded into the device. The end of the blanket roll is threaded over the guide roller and under the compression wheels and is then manually stapled or staked into place by hand. This is done to ensure that the end of the roll stays in place and the roll unwinds properly as the device is towed forward. The tractor driver will lower the furrow blades via the hydraulic control lever mounted near the driver's seat. The blades cause the device to rise about 6" from the ground. Then the driver will engage the power take-off which powers the air compressor.

For use with stakes, a furrow blade preferably readies the ground for penetration. Once the tractor begins towing the device at the predetermined speed, the furrow blades will immediately dig into the ground to a depth of 5" to 6" and the device will be lowered onto the spring-loaded compression wheels. Because blanket 90 is positioned between wheels 70 and the ground, blanket 90 will unroll. At the same time, three guns 60 will fire stakes 62 through blanket 90 into the furrows in the ground. Stakes 62 lock in the ground and anchor the blanket in place until turf or vegetation grows through blanket 90 and naturally stabilizes the ground.

When the roll expires, another blanket roll is installed in the device and the cartridges are refilled. The end of the new roll is again manually stapled or staked and the process is repeated.

Use of the novel device with a tractor connected via a three-point hitch allows an erosion blanket to be installed and stapled or staked in place with 3 rows of staples or stakes. A 500 yard erosion blanket roll can be installed and sufficient staples or stakes can be reloaded in the device in 15 minutes. Such a device allows two people to install a 500 yard roll in the device. For use with stakes, the device preferably creates 3 rows of 6" deep furrows into which the 6" biodegradable stakes are driven by a pneumatic gun. Such furrows are created by 9" curved blades connected to the bottom of the device. Furrows are not necessary for use with staples.

Thus, it should be apparent that there has been provided, in accordance with the present invention, a novel device for efficiently and effectively installing erosion blankets on ground surfaces that fully satisfies the objectives and advantages set forth above.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A method of installing an erosion blanket on a ground surface with a blanket-laying device comprising:

propelling the device along a pathway, the device holding a roll of the erosion blanket;

rotating the roll such that the erosion blanket unwinds and lies upon the surface along the pathway; and in conjunction with the rotating step, mechanically piercing the erosion blanket to fasten the blanket to the ground.

2. The method of claim 1 wherein the rotating and piercing actions are performed simultaneously.

3. The method of claim 1 wherein the rotating and piercing actions are performed continuously until the roll expires.

4. The method of claim 1 wherein the blanket is fastened to the surface pneumatically.

5. The method of claim 1 further comprising pressing the blanket to the surface as it unwinds from the roll to allow for effective surface coverage.

6. The method of claim 5 wherein compression wheels press the blanket to the surface.

7. The method of claim 6 wherein at least 3 axially-spaced compression wheels press the blanket to the surface.

8. The method of claim 1 further comprising furrowing the surface before piercing the blanket.

9. The method of claim 8 wherein at least 3 blades furrow the surface.

10. The method of claim 1 wherein the device is propelled along the pathway at at least about 3 mph.

11. The method of claim 1 wherein the erosion blanket is installed on the surface at a rate of at least about 400 feet/minute.

12. The method of claim 11 wherein the erosion blanket is installed on the surface at a rate of at least about 500 feet/minute.

13. The method of claim 1 wherein stakes pierce the blanket to fasten the blanket to the ground.

14. The method of claim 13 wherein the stakes are biodegradable.

15. The method of claim 13 wherein the stakes are forced through the blanket into the ground by an air compressor included in the device.

16. The method of claim 13 wherein the number of stakes held by the device is proportional to the length of the roll and further comprising:

loading stakes and another roll of the blanket with respect to the device upon expiration of the roll;

propelling the device along a pathway;

rotating the roll such that the blanket unwinds and lies on the surface along the pathway; and in conjunction with the rotating step, mechanically fastening the blanket to the ground by piercing the blanket and ground with fasteners.

17. The method of claim 16 wherein the loading stakes and another roll action is accomplished in less than about 15 minutes.

18. The method of claim 17 wherein the rolls are 500 yards long and at least 15,000 yards of blanket are installed in 8 hours.

19. The method of claim 1 wherein staples pierce the blanket and ground to fasten the blanket to the ground.

20. A method of installing an erosion blanket along a pathway on a ground surface comprising:

providing a roll of an erosion blanket;

supporting the roll in a device;

propelling the device in a direction along a pathway; and unwinding the roll so that the blanket covers the pathway, the device automatically fastening the blanket to the ground surface as it unrolls by piercing the blanket and ground with fasteners.

21. The method of claim 20 further comprising pressing the blanket to the surface as it unwinds to allow for effective surface coverage.

22. The method of claim 20 wherein compression wheels press the blanket to the surface.

23. The method of claim 22 wherein at least 3 axially-spaced compression wheels press the blanket to the surface.

24. The method of claim 20 further comprising furrowing the surface while propelling the device.

25. The method of claim 24 wherein at least 3 blades furrow the surface.

26. The method of claim 20 wherein stakes fasten the blanket to the ground by piercing the blanket and ground.

27. The method of claim 26 wherein the stakes are biodegradable.

28. The method of claim 26 wherein the stakes are forced through the blanket into the ground by an air compressor included in the device.

29. The method of claim 20 wherein staples fasten the blanket to the ground by piercing the blanket and ground.

30. The method of claim 20 wherein the erosion blanket is installed on the surface at a rate of at least about 400 feet/minute.

31. The method of claim 30 wherein the erosion blanket is installed on the surface at a rate of at least about 500 feet/minute.

32. A device for laying an erosion blanket along a pathway on the ground, the erosion blanket positioned on a blanket axle, the device comprising:

a device frame for moving along the pathway;

an axle arm connected to the device frame, the axle arm engaging the blanket axle to support the erosion blanket substantially horizontally over the ground; and at least one gun capable of fastening the blanket to the ground by piercing the blanket and ground with fasteners, the gun connected with respect to the frame.

33. The device of claim 32 further comprising a blanket guide roller for directing the blanket to the ground upon unwinding.

34. The device of claim 32 further comprising at least one furrow blade connected with respect to the frame, the blade furrowing the ground during movement of the device.

35. The device of claim 34 further comprising a furrow bar supporting the at least one furrow blade and connected to a hydraulic cylinder for urging the at least one furrow blade into the ground.

36. The device of claim 34 wherein the at least one furrow blade is three furrow blades.

37. The device of claim 32 further comprising hitch connection points positioned with respect to the frame, the hitch connection points allowing connection of the device to a hitch.

38. The device of claim 32 further comprising an air compressor connected to the gun for forcing stakes through the blanket into the ground.

39. The device of claim 32 further comprising a retractable arm connected with respect to the frame, the retractable arm movable between an open position in which the roll is loaded and the blanket axle engages the axle arm and a closed position in which the retractable arm engages the blanket axle.

40. The device of claim 39 further comprising a spring-loaded retractable-arm pin connected with respect to the frame and pivotably supporting the retractable arm with respect to the frame.

41. The device of claim 40 further comprising a retractable-arm brace connecting the retractable-arm pin to the frame.

42. The device of claim 32 further comprising at least one compression wheel for pressing the blanket against the ground as the blanket unwinds.

43. The device of claim 42 further comprising a compression-wheel frame for supporting the at least one compression wheel.

44. The device of claim 43 further comprising at least one cartridge for supplying the gun and wherein the compression-wheel frame supports the at least one gun and the at least one cartridge.

* * * * *